United States Patent [19]

Krehbiel

[11] 4,358,194

[45] Nov. 9, 1982

[54] TRANSPORT FOR DEVELOPING FILM IN A PHOTOGRAPHIC FILM PROCESSOR

[75] Inventor: V. Dwight Krehbiel, Wichita, Kans.

[73] Assignee: Kreonite Inc., Wichita, Kans.

[21] Appl. No.: 287,918

[22] Filed: Jul. 29, 1981

[51] Int. Cl.[3] ..... G03D 3/08

[52] U.S. Cl. ..... 354/320; 226/171; 226/189; 226/190; 308/20; 308/30

[58] Field of Search ..... 354/320, 321, 322, 328; 226/171, 189, 190; 74/421 R, 665 GA; 403/6; 308/20, 30, 34

[56] References Cited

U.S. PATENT DOCUMENTS

| | | | |
|---|---|---|---|
| 2,685,831 | 8/1954 | Strandberg | 354/322 |
| 3,287,013 | 11/1966 | Fairbanks | 354/339 |
| 3,413,904 | 12/1968 | Friedel | 354/322 |
| 3,533,349 | 10/1970 | Schmidt | 354/321 |
| 3,760,705 | 9/1973 | Miller | 354/322 |
| 3,807,616 | 4/1974 | Hope et al. | 308/20 |
| 4,002,280 | 1/1977 | Coleman et al. | 226/189 |
| 4,140,384 | 2/1979 | Shintani et al. | 354/321 |

*Primary Examiner*—L. T. Hix
*Assistant Examiner*—Alan Mathews
*Attorney, Agent, or Firm*—Edwin H. Crabtree

[57] ABSTRACT

An improved transport for developing film in a photographic film processor, the transport received in a tank having film processing liquids therein. The transport characterized by having a housing with film guide rollers that are mounted on removable bearings so that the individual rollers can be quickly removed from the housing without having to disassemble the housing end plates. Further, the transport is modular in design so that the housing end plates with rollers can be added or subtracted for changing the film process cycle time.

11 Claims, 6 Drawing Figures

TRANSPORT FOR DEVELOPING FILM IN A PHOTOGRAPHIC FILM PROCESSOR

BACKGROUND OF THE INVENTION

This invention relates to an improved transport for film processing and more particularly, but not by way of limitation, to a film transport having a plurality of rollers mounted on a transport housing having a common center roller system used for guiding the film down one side of the film processing tank and upwardly along the opposite side of the tank.

Heretofore, there have been various improved film transport equipment using rollers and gear drives such as:

U.S. Pat. No. 4,002,280 to Coleman, et al
U.S. Pat. No. 4,140,384 to Shintanil
U.S. Pat. No. 3,533,349 to Schmidt
U.S. Pat. No. 3,413,904 to Fridel
U.S. Pat. No. 3,287,013 to Fairbanks, et al
U.S. Pat. No. 2,685,831 to Strandberg.

None of these prior art film processors, roller frames, film developing machines, and conveyors disclosure the unique features and advantages of the subject invention as described herein.

SUMMARY OF THE INVENTION

The improved transport for developing film includes unique "snap-out" bearings which are received in apertures in the end plates of a transport housing with the bearings rotatably mounted on the ends of film transport rollers. By simply urging the bearings outwardly from the housing end plates, the individual rollers can be slidably removed from the transport housing thereby greatly reducing the time in removing rollers which heretofore required a complete disassembly of the transport housing.

The rollers are attached at one end to gears which form a gear train and are chain driven which reduces the torque required in rotating the rollers.

The rollers are disposed in a spaced relationship to each other using a common center roller system thereby minimizing the number of rollers required.

The transport housing is modular in design and by adding and subtracting the end plates to the overall length of the housing, the process cycle times can be changed as required.

The transport further includes triangular shaped bars which are used as tie bars for securing the end plates together with the design of the bars acting as agitation bars by diverting the processing liquids toward the film as it is circulated inside the tank.

The improved transport further includes a unique master link chain design for driving the gear train attached to the rollers. By having each link of the chain a master link, random adjusting of the chain can be made.

The transport also includes an endless belt rotatably mounted on rollers disposed at the top of the tank. The belt is adapted for receiving the film from an adjacent tank and guiding the film between the rollers and discharging the film from the tank after the film has been guided between the rollers downwardly and upwardly in the tank. This endless belt eliminates the need of cross-over guides.

The improved transport for developing film in a photographic film processor which is received in a tank having film processing liquids includes a transport housing having a pair of end plates joined together in a spaced relationship by tie rods. A plurality of rollers are rotatably mounted on removable bearings. The bearings are received in a press-fit in apertures in the sides of the end plates. The diameter of the apertures is greater than the outer diameter of the rollers so that when the bearings are snapped out of the apertures in the end plates, the rollers can be slidably received through the apertures without removing the end plates from the tie rods. The rollers further are disposed in a center roller design and in a spaced relationship to each other for receiving the film therebetween and guiding the film downwardly along one side of the tank and upwardly along the opposite side of the tank. The ends of the rollers are attached to gears which form a gear train which is rotatably driven by a master link endless chain design.

The advantages and objects of the invention will become evident from the following detailed description of the drawings when read in connection with the accompanying drawings which illustrate preferred embodiments of the invention.

DETAILED DESCRIPTION OF THE DRAWINGS

Figure 1:
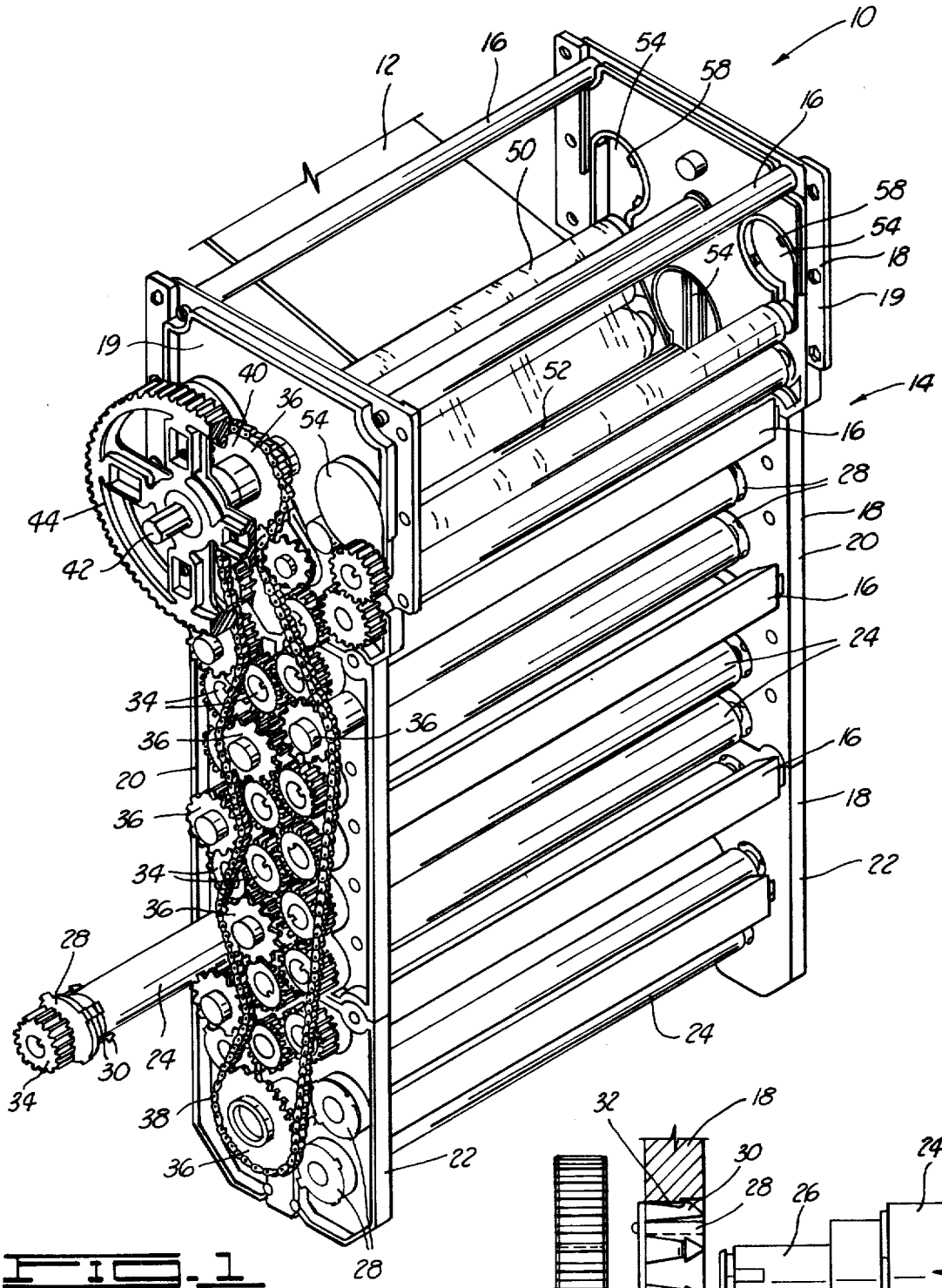
FIG. 1 is a perspective view of the improved transport for developing film in a photographic film processor.

In FIG. 1 a perspective view of the improved film transport is shown and designated by general reference numeral 10. The transport 10 is received in a tank which is not shown in the drawings. It can be appreciated by those skilled in the art of photographic film processing that a plurality of tanks are used adjacent to each other for receiving different film developing liquids and a film dryer with each tank receiving the transport 10 therein. Also, it can be appreciated that a continuous roll or sheet of exposed film 12 is conveyed from one transport 10 to the next until the film 12 has been completely processed.

Figure 4:
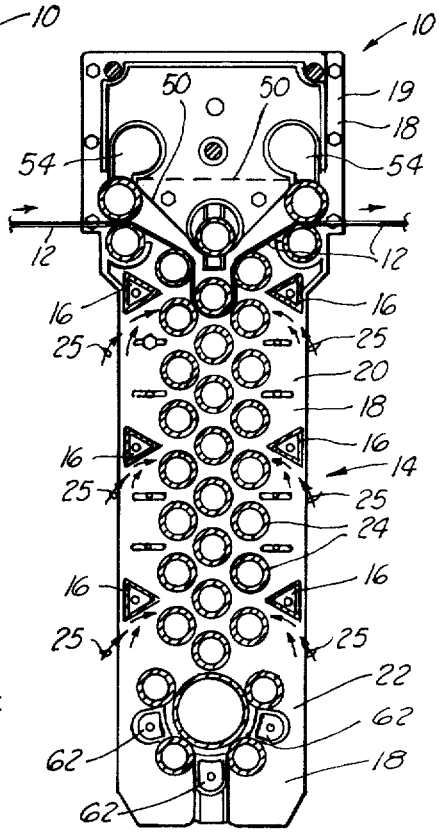
FIG. 4 is a front sectional view of the transport housing taken along lines 4—4 shown in FIG. 3.

The transport 10 includes a transport housing 14 having a plurality of tie bars 16 joined together by end plates 18. The end plates 18 are shown as a pair of top plates 19, a pair of center plates 20, and a pair of bottom plates 22. The lower tie bars 16 are shown in the form of triangular shaped tubular agitation bars which act to deflect the processing liquids toward the film 12 as it is guided between a plurality of hard non-impingement rollers 24 having a common center roll design. This design is used to minimize the number of rollers 24 required to guide the film 12 down one side of the tank and upwardly along the opposite side of the tank. In FIG. 4 arrows 25 are shown to represent how the film processing liquid, when circulated inside the tank, contacts the triangular sides of the agitation bars 16 and toward the rollers 24 guiding the film 12 therebetween.

Figure 2:
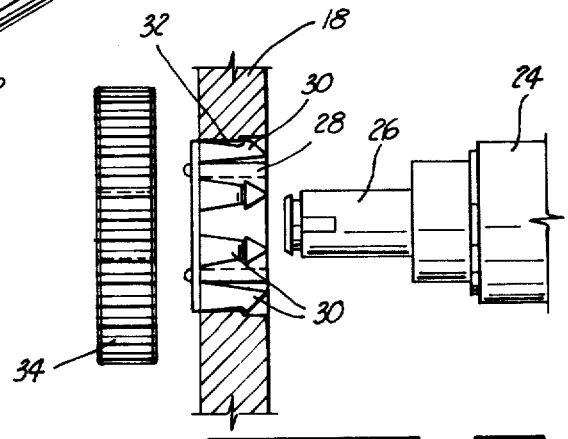
FIG. 2 is an enlarged side partial view of one end of a roller positioned for receipt in the removable bearing.

The ends of the rollers 24 include a bearing surface 26 shown in FIG. 2. The bearing surface 26 rides inside a removable bearing 28. The bearing 28 has a plurality of flexible fingers 30 which engage the sides of an aperture 32 in a snap-fit in the side of the end plate 18. The end plates 18 include a plurality of the apertures 32 so that the bearings 28 can be received therein and the rollers 24 rotatably mounted thereon. The diameter of the apertures 32 is greater than the outer diameter of the rollers 24. By applying pressure along the axis of the roller 24 and at one end of the roller 24, the bearing 28 can be quickly disengaged from the end plate 18 and the roller 24 slidably removed through the apertures 32 in the end plate 18. Through this method of disengaging the rollers 24, it is no longer required to remove the end plates 18 from the tie bars 16 and completely disassemble the housing 14.

In FIG. 1, one of the rollers 24 can be seen extending outwardly to the left from the center plate 20 with the removable bearing 28 released from its snap-fit in the aperture 32. The rollers 24 also include a plurality of gears 34 which are slidably received around the end of the bearing surface 26 of the rollers 24 and secured thereto. The gears 34 mesh with adjacent gears 34 to form a gear train. The gear train is driven by a plurality of drive sprockets 36 which are interconnected by an endless chain 38 having chain links with each link a master link to allow for random adjusting of the length of the chain. An upper drive sprocket 40 is mounted on a drive shaft 42 which is connected to a main drive gear 44. The main drive gear 44 is connected to the overall drive system of the film processor and this system is not shown in the drawings. By using a combination of the endless chain 38 mounted on the drive sprockets 36 for driving short gear train transport sections, the overall accumulation of stress and wear on the rollers 24 is reduced when compared to typical all-gear drive film processor transport systems.

In FIG. 2 one of the gears 34 is shown in position for receipt on the end of the roller 24 when the bearing surface 26 extends through the center of the removable bearing 28 and through the open center of the gear 34.

Also shown in FIG. 1 and mounted on three of the upper rollers 24 attached to the top plate 19 is an endless belt 50 received thereon for receiving the leading edge of the film 12 and guiding the film 12 into the transport housing 14 and between the rollers 24. Also, the endless belt 50 acts in discharging the film 12 from the transport housing 14 to the adjacent transport 10 as the film 12 is guided from tank to tank. A weighted roller 52 is placed on top of the endless belt 50 and acts to hold the belt 52 in tension as the belt 50 is rotated on the rollers 24. The upper rollers 24 which engage the endless belt 50 can be removed from the top plate 19 by quickly removing bearing retainer caps 54 which are received in a snap-fit in the sides of the top plates 19. The caps 54 are received in enlarged apertures 58 with a portion of the aperture 58 acting as a bearing surface for receiving the bearing surface 26 of the rollers 24.

It can be appreciated that by removing the three caps 58 in the two top plates 19, the three rollers 24 which receive the endless belt 50 thereon can quickly be moved upwardly and the rollers 24 slidably removed through the apertures 60, and the belt 50 if required can be replaced or maintenance performed thereon. The belt 50 eliminates the need of cross-over guides. The belt 50 may be made of various plastic materials such as polyethylene. Also, a sock-like stretchable synthetic fabric may be used, and in this case the weighted roller 52 is not required with the belt 50, and as shown in FIG. 4 with the top of the belt 50 in dotted lines.

Figure 3:
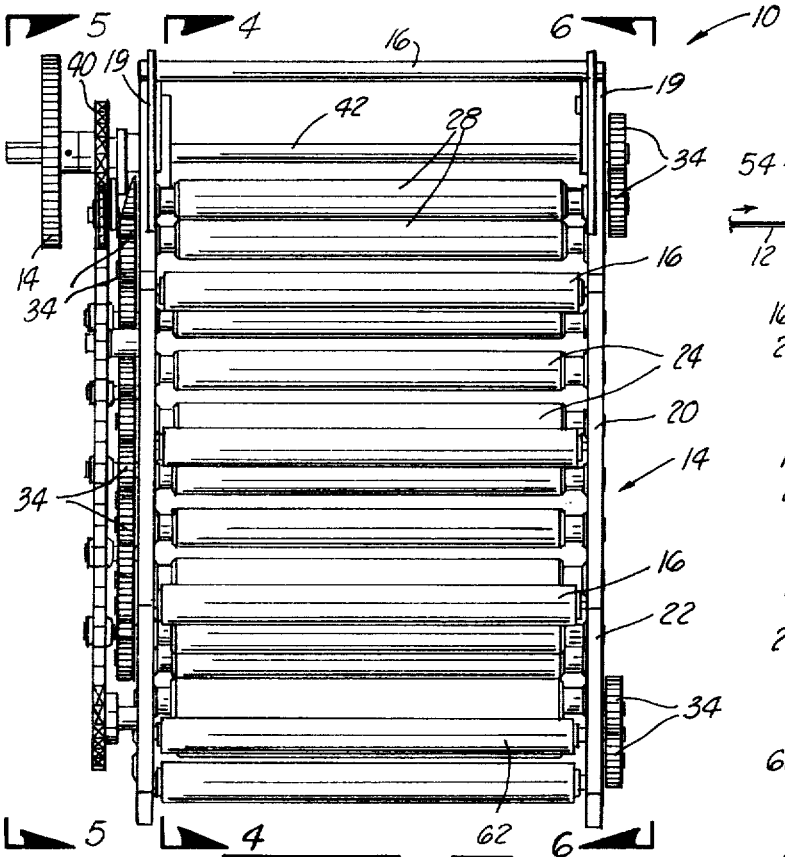
FIG. 3 is a side view of the transport housing and rollers.

In FIG. 3, a side view of the transport 10 can be seen with the drive shaft 42 extending across the top of the transport housing 14 and rotatably mounted on the top plate 19 with the main drive gear 44 attached to one end. Also attached to the main drive gear 42 is the upper drive sprocket 40 receiving the endless chain 38 thereon. In this view, it can be seen that some of the gears 34 form a gear train on the lefthand side of the transport housing 14, while some of the upper and lower rollers 24 are driven by a gear train on the right-hand side of the housing. In this gear train configuration, long gear train transmission is eliminated.

In FIG. 4 an end cross section of the transport 10 is shown taken along lines 4—4 shown in FIG. 3. Also a cross section of the endless belt 50 can be seen driven by three of the upper rollers 24 with the weighted roller 52 received on the top thereof for holding the belt 50 in tension. Further, FIG. 4 illustrates the belt 50 guiding a sheet of film 12 into the housing 14 and between the rollers 24 and discharging the film 12 outwardly toward the right. Also seen in this view are three turnaround guides 62 which are disposed between the lower rollers 24 mounted on the bottom plate 22. The turnaround guides 62 act to guide the film 12 around the bottom of the transport housing 14 and upwardly along the opposite side of the housing 14 prior to discharging the film 12 from the transport 10.

Figure 5:
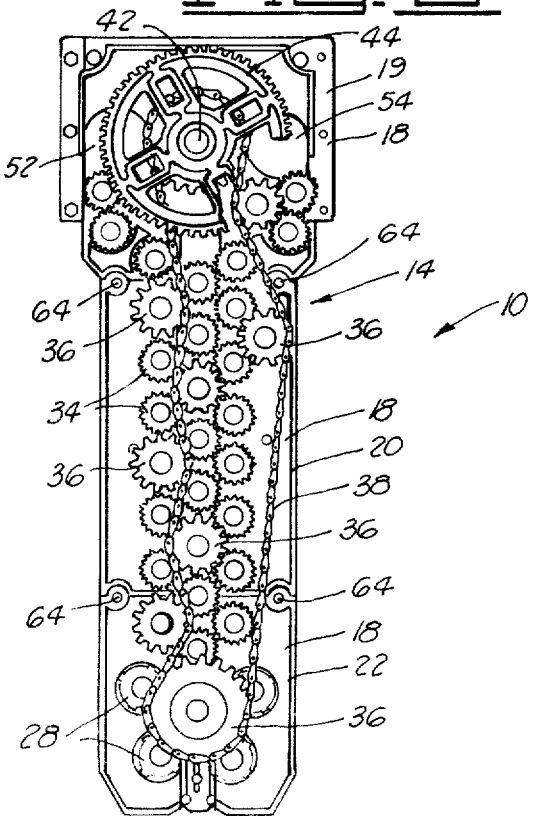
FIG. 5 is a front view of the transport housing taken along lines 5—5 shown in FIG. 3.

In FIG. 5 a front view of the transport 10 is shown taken along lines 5—5 shown in FIG. 3. The endless chain 38 can be seen interconnecting the drive sprockets 36 which in turn are connected to the gears 34 for driving the rollers 24 thereon. Also in this view it can be seen how the top plate 19 is attached to the top of the center plate 20 by screws 64, with the center plate 20 disposed on top of the bottom plate 22 and attached by screws 64. It should be appreciated that if the cycle time of the film 12 needs to be increased, an additional pair of center plates 20 can be added to increase the overall length of the housing 14 or in turn, if it is desired, to decrease the cycle time of the film processing, the center plate 20 can be removed with the bottom plate 22 then connected directly to the top plate 19. By quickly removing the tie bars 16, and adding or substracting the end plates 18, the unique transport 10 becomes modular in design, providing the user of the transport greater flexibility in film processing cycle time.

Figure 6:
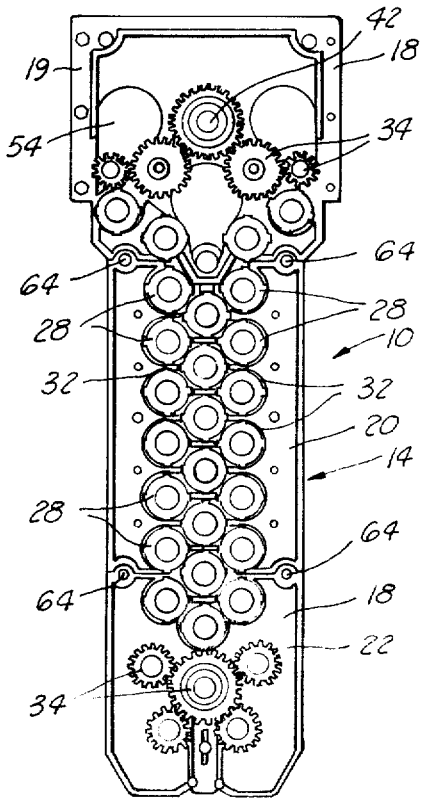
FIG. 6 is an opposite front view of the transport housing taken along lines 6—6 shown in FIG. 3.

In FIG. 6 an opposite end view of the transport 10 can be seen taken along lines 6—6 shown in FIG. 3. In this view a plurality of the removable bearings 28 can be seen mounted in apertures 32 in the end plates 18. Also seen in this view is a gear train formed in the top plate 19 and a gear train formed in the bottom plate 22 for driving the rollers 24 thereon.

While the drawings show a specific arrangement of drive sprockets 36 and gears 34 forming a particular gear train for driving the rollers 24 on the housing 14, it can be appreciated that different types and arrangements of gear trains can be formed using the common center roller system to minimize the number of the hard non-impingement rollers 24.

Changes may be made in the construction and arrangement of the parts or elements of the embodiments as disclosed herein without departing from the spirit or scope of the invention as defined in the following claims.

I claim:

1. A transport for developing film in a photographic film processor, the transport received in a tank having film processing liquids therein, the transport comprising:

a transport housing having a pair of end plates joined together in a spaced relationship by tie rods;

a plurality of rollers, the opposite ends of the rollers rotatably mounted on removable bearings, the bearings received in a press-fit in apertures in the sides of the end plates, the diameter of the apertures greater than the outer diameter of the rollers so that when the bearings are removed from the apertures, the rollers can be slidably received through the apertures without removing the end plates from the tie rods, the rollers disposed in a spaced relationship to each other for receiving the film therebetween and guiding the film downwardly along one side of the tank and upwardly along the opposite side of the tank; and means for rotating the rollers on the housing.

2. The transport as described in claim 1 wherein more than one of the tie rods joining the end plates are triangular in shape and act as agitation bars by diverting the processing liquids as it is circulated in the tanks toward the film as it is guided between the rollers.

3. The transport as described in claim 1, wherein the transport housing is modular in design and by adding additional pairs of end plates to the ends of the existing pair of end plates and additional rollers, the length of the housing can be increased for added film cycle processing time in the tank.

4. The transport as described in claim 1 wherein the means for rotating the rollers are gears attached to the ends of the rollers and forming a gear train driven by an endless chain.

5. The transport as described in claim 4, wherein the endless chain includes chain links wherein each link is a master link to allow random adjusting of the chain length.

6. The transport as described in claim 1 further including an endless belt rotatably mounted on more than one of the rollers disposed at the top of the tank housing, the belt adapted for receiving the film from an adjacent tank and guiding the film between the rollers, the belt further adapted for discharging the film from the tank after the film has been guided by the rollers downwardly and upwardly in the tank.

7. A transport for developing film in a photographic film processor, the transport received in a tank having film processing liquids therein, the transport comprising:

a modular transport housing having a plurality of end plates joined end-to-end, the end plates forming two sides of the housing and joined together in a spaced relationship by tie rods;

a plurality of rollers, the opposite ends of the rollers rotatably mounted on removable bearings, the bearings received in a press-fit in apertures in the sides of the end plates, the diameter of the apertures greater than the outer diameter of the rollers so that when the bearings are removed from the apertures, the rollers can be slidably received through the apertures without removing the end plates from the tie rods, the rollers disposed in a spaced relationship to each other for receiving the film therebetween and guiding the film downwardly along one side of the tank and upwardly along the opposite side of the tank; and a plurality of gears attached to one end of the rollers and forming a gear train driven by an endless chain.

8. The transport as described in claim 7 further including an endless belt rotatably mounted on more than one of the rollers and disposed at the top of the tank housing, the belt adapted for receiving the film from an adjacent tank and guiding the film between the rollers, the belt further adapted for discharging the film from the tank after the film has been guided by the rollers downwardly and upwardly in the tank.

9. The transport as described in claim 8, further including a weighted roller received on top of the endless belt and riding thereon, the weighted roller holding the endless belt in tension so that there is no slack in the belt when the film is received thereon.

10. The transport as described in claim 8 wherein, the endless belt is made of a plastic material such as polyethylene.

11. The transport as described in claim 8 wherein, the endless belt is made of a sock-like stretchable synthetic fabric.

* * * * *